US011629846B2

(12) United States Patent
Carlin

(10) Patent No.: US 11,629,846 B2
(45) Date of Patent: Apr. 18, 2023

(54) LIGHT MODIFYING DEVICE

(71) Applicant: Jena Carlin, Auburndale, WI (US)

(72) Inventor: Jena Carlin, Auburndale, WI (US)

( * ) Notice: Subject to any disclaimer, the term of this patent is extended or adjusted under 35 U.S.C. 154(b) by 0 days.

(21) Appl. No.: 17/847,868

(22) Filed: Jun. 23, 2022

(65) Prior Publication Data

US 2022/0412535 A1 Dec. 29, 2022

Related U.S. Application Data

(60) Provisional application No. 63/215,337, filed on Jun. 25, 2021.

(51) Int. Cl.
*F21V 9/08* (2018.01)

(52) U.S. Cl.
CPC ..... *F21V 9/08* (2013.01)

(58) Field of Classification Search
CPC ..... F21V 9/08
See application file for complete search history.

(56) References Cited

U.S. PATENT DOCUMENTS 4,544,120 A * 10/1985 Lowell ..... F16M 11/105 24/523
6,411,332 B1 * 6/2002 Whitby ..... H04N 5/2251 348/E5.025
8,659,764 B2 * 2/2014 Hatzilias ..... G01B 11/2513 356/601
8,712,234 B1 * 4/2014 Lau ..... G03B 15/06 396/544
2013/0070440 A1 * 3/2013 Levermore ..... F21V 9/08 362/255
2015/0055319 A1 * 2/2015 Zink ..... F21V 9/08 362/84

* cited by examiner

*Primary Examiner* — Mary Ellen Bowman
(74) *Attorney, Agent, or Firm* — Carlin Law LLC

(57) ABSTRACT

A Light Modifying Device adapted for use for photography. The Light Modifying Device is a generally bendable and durable tear-resistant material comprising of two surface faces comprising a plurality of irregularly shaped openings for receiving light therein. The Light Modifying Device can be positioned in a variety of locations and additionally manipulated by way of bending such that a portion of light may be diffused in one location in a photography set and enhanced or otherwise differently diffused on a different, second particular location of the same photography set.

20 Claims, 5 Drawing Sheets

LIGHT MODIFYING DEVICE

CROSS REFERENCE TO RELATED APPLICATION

This application claims the benefit of U.S. Provisional Application 63/215,337, filed Jun. 25, 2021.

FIELD

The present invention is directed to the field of light modifying systems, and more particularly to devices related to modifying light for lighting equipment within photography, video, cinematic, and imaging services.

INTRODUCTION

Light modifying systems are utilized to highlight a subject, sometimes referred to as a hero or as a product. It is known to those with general skill in the art of photography, video, cinematic, and imaging services—referred to herein generally as photography—that too focused of light can create glare or extreme shadows in the image or shot or clip.

As is known by those with ordinary skill in the art of photography, instruments, structures or devices can be employed that shape, modify, reflect, alter, diffuse, enhance, or outright block light from reaching a subject, be it person, animal, or inanimate object.

Professionals in the field, sometimes referred to as grips, or as is used herein, photographers, utilize a number of different devices to help with their image construction. One of these types of devices is known as a cucoloris. As used herein, a cucoloris will also include similar devices known as flags, and other similar devices known as scrims. The word cucoloris is also commonly spelled or referred to as a cuculoris, kookaloris, cookaloris, cucaloris, cookie, cookoo, kook, cuke, celocuke, gobo, or ulcerboard. There are certainly other terms which are used colloquially, informally, or otherwise by those within the art. Generally, a cucoloris or the like is used to break up strong light waves by casting a shadow on the subject. The cucoloris also may produce an illumination or silhouette on the subject, to blend or what is known as feather the edges of the casted light or natural light wave.

However, photographers struggle with the portability of cucoloris, as they are generally rigid materials made of wood or hard plastic. This causes operability concerns related to the strength needed to hold a cucoloris in place. Another concern relates to the storage and ease of transportation. Many photographers when traveling to an outdoor photoshoot, or to another studio for film or photography or the like, do not have a large tractor trailer with which to bring their entire collection of equipment, props, and essentials. Therefore, they must bring bare essentials, and be quite strategic about what to leave behind and how to pack their vehicle.

Other cucoloris concerns relate to the hard lines which are cast as shadows from the straight edges on most cucoloris devices, which requires another cucoloris to diffuse the shadows created by the shadow creating first cucoloris. Thus, multiple devices may be used, and they need to operate specifically so as to amplify and not minimize each other.

As photography, video, and other artistic sets can be a bustling location, a cucoloris may need to be resistant to some possible hazards, such as liquid. Being generally water or liquid resistant may be essential to prevent depletion of life of the device itself.

Further, cucoloris devices in use are straight and rigid, as previously stated. Certain scenes may call for a more uniquely created shadow to be cast.

What is needed, therefore, is a portable device which can properly diffuse or modify light so as decrease the likelihood of creating glare, or harsh shadows, as well as to increase the aesthetic qualities of an image, shot, or clip. Preferably, this device is lightweight, water-resistant, tear-resistant, and bendable.

BRIEF SUMMARY OF THE INVENTION

The present invention is directed to a bendable Light Modifying Device which has non-linear edges. The Light Modifying Device is durable and an effective way to manipulate incoming light, such that the non-linear edges allow for light to be generally diffused without creating a harsh shadow line.

The Light Modifying Device is comprised of a generally durable material, such as plastic, a metal alloy, or any other generally rigid material which is preferably resistant to general wear and tear. The durability provided by the material also allows for sustainability, and the ability to moveably readjust the position of the Light Modifying Device itself.

The Light Modifying Device is substantially composed of a single piece of plastic, light metal, bendable plexiglass, or similar material that has a generally pliable property while also being generally tear-resistant and generally durable. The material is generally flat or otherwise a consistent length in a general direction, which creates two sides, otherwise known as faces; it may be referred to as a front face and a rear face, or a first face or a second face or the like. The dimensions of the Light Modifying Device may vary based upon the particular use, with all heights, widths, lengths, and sizes being presently thought to be properly disclosed herein.

The shape of the surface of the Light Modifying Device is thought to be generally irregular by way of the non-linear edges, even when constructed in a generally square or generally rectangular shape, but it may also be further irregular in an oblong shape. It is presently thought that the particular shape is irrelevant to achieve the functionality of the present disclosure.

Upon the faces of the Light Modifying Device are a series of defined openings with which light waves may ingress and egress. These openings are generally non-congruent and irregularly shaped, as is shown in the Figures.

The material with the properties as described allows for the ability to bend which allows for ease of storage as well as manipulation of the surface of the Light Modifying Device itself. In such a fashion, this creates extremely unique scattered light, and thus differing shadows therefrom. For instance, part of a scene or a set may be highlighted with light while the remainder of the scene or set is diffused or darkened when juxtaposed with the aforementioned highlighted portion of the scene or set. A subject material may be more easily lit without too much glare, and without the harsh shadows created from a linear edged scrim, flag, gobo, cucoloris, or the like.

Many embodiments of the Light Modifying Device may be enhanced by the color of the surface material itself. It is presently thought that a transparent clear surface may allow for light to enter, and alternatively a partially opaque color may be used to diffuse light. A frosted clear color would allow for reduced incoming light to create a softening appearance. A dark color such as black may block most radiant light to create shadowing. Different colors may be employed to create different hues, or gradients of color, on the set by modifying incoming light through the Light Modifying Device. For instance, a generally red color may create a sepia look, a generally green color may create a Victorian look, a silver color could enhance whites or bring a metallic feel, and so on. Those with skill in the art will understand and appreciate that different colors may bring about different color schemes of the photographic images to be produced.

In one embodiment, the Light Modifying Device has a finish on one face, and a second different finish on the second face. One example may be a black or otherwise generally opaque light-resistant colored face, wherein the second face is a face with a mirrored finish thereon. Such a mirrored finish will additionally allow a human user to reflect or cast light from a light source upon a subject. The Light Modifying Device may thus be reversed in its position should the light source not need to be mirrored. The artistic capabilities and numerous features therefrom are obvious to those with skill in the art of photography, video, cinematic, and imaging services.

According to one embodiment of the present disclosure the Light Modifying Device additionally comprises attachment methods such that a plurality of Light Modifying Device surfaces can be used in tandem. The conjunction of the two or more Light Modifying Device surfaces allows for certain hues to be placed on specific areas of the scene or set, or for particular subjects to be enhanced or reduced in focus. Additionally, should a subject material have a glossy or reflective quality, a particular Light Modifying Device surface may be employed to soften or diffuse the incoming light on that particular subject material alone.

The attachment methods may be a variety of different methods. Each one may be utilized in a different variation or embodiment, depending on the intended use of the Light Modifying Device itself. One embodiment of the present disclosure allows for attachment and reattachment or otherwise removability after initial connection. For instance, magnets may be used should the material surface be metal or conducive to magnet.

Another example is static clings, window clings, or vinyl material clings. Further, suction cups, double-sided tape, hook and loop, hook and hook, stretch releasing adhesive tape, or any type of generally removable adhesive may be used. These just-mentioned methods may be attached to customizable shapes, wherein a user can cut, form, or use an already created shape and attach to cover all or some of a defined opening, or openings as the case may be.

Another embodiment allows for attachment and reattachment by way of permanent attachment components such as clips or grommets. The clips would allow for a second Light Modifying Device, wherein the second Light Modifying Device is of lesser size than the first Light Modifying Device, to be positioned to cover some of the defined openings. Utilizing a grommet would allow for the rotational movement of the second Light Modifying Device around the radius point of the grommet.

As previously mentioned, the Light Modifying Device of the present disclosure does not have linear edges. This will allow even the distal ends of the surface to be used to diffuse light without creating harsh shadows. Further, a second Light Modifying Device may be affixed or attached thereon to cover one or more of the defined openings of the Light Modifying Device faces, such that light waves are diffused or entirely blocked therefrom.

It is presently thought that a handle may be affixed to an end of the Light Modifying Device. The handle may be of a variety of sizes or lengths and adapted for its particular and intended use. One variation of the handle is a wooden, metal, plastic, or otherwise durable material adapted for grasping by a human hand.

An additional method for the handle is to utilize a photography C-Stand, wherein it may fit within said C-Stand locking device, clamp, handle, knuckle, or other attachment member or method thereon, and said C-Stand or the like connects to the end of the handle and securely positions the Light Modifying Device in its hanging position, as shown herein in the figures.

Another method of said handle is to utilize a bendable flexible gooseneck tubing for said handle. This allows for manipulation of multiple angles. At one end of the gooseneck tubing is a solid base, wherein said base comprises substantial weight or an element with sufficient weight positioned therein such that the Light Modifying Device is able to be freestanding as is shown in the below Figures, without tipping over due to the positioning and repositioning of the light modifying device or devices as shown. The gooseneck tubing adaptably receives the handle of the Light Modifying Device, so that a human user is not required to hold the Light Modifying Device in position, nor is a C-Stand or the like required for same.

The gooseneck tubing may alternatively be connected on the second distal end to the Light Modifying Device itself, negating the need for a separate handle, or it may be a removably attached component such that a separate handle of the Light Modifying Device can removably detach from the gooseneck tubing and thus the Light Modifying Device may be used independently therefrom, by way of a clamp or a threaded attachment connection point.

Should a user desire to utilize multiple components of colors or need additional Light Modifying Device surface area, an additional Light Modifying Device surface may be employed, as referred to and described above. A presently contemplated embodiment allows for a single base with multiple gooseneck tubing, or a plurality of individual bases with said gooseneck tubing, to manipulate the positioning of each Light Modifying Device surface. In such a fashion, the different surfaces may overlap in different axis and allow for precise manipulation thereof as to each Light Modifying Device.

These and various other features, advantages, modes, and objects of the present invention will be made apparent from the following detailed description and any appended drawings.

DRAWINGS DESCRIPTION

One or more preferred exemplary embodiments of the disclosed invention are illustrated in the accompanying drawings in which like reference numerals represent like parts throughout and in which.

Before explaining one or more embodiments of the disclosed invention in detail, it is to be understood that this invention is not limited in its application to the details or modes of construction and the arrangement of the components set forth in the following description or previously disclosed illustrations. This invention is capable of multiple embodiments and modes, which can be practiced or carried out in many various ways. Also, it is to be understood that the phraseology and terminology employed herein is for the purpose of description, and should not be regarded as limiting, or used as an absolute.

DETAILED DESCRIPTION OF THE PREFERRED EMBODIMENT

Figure 1:
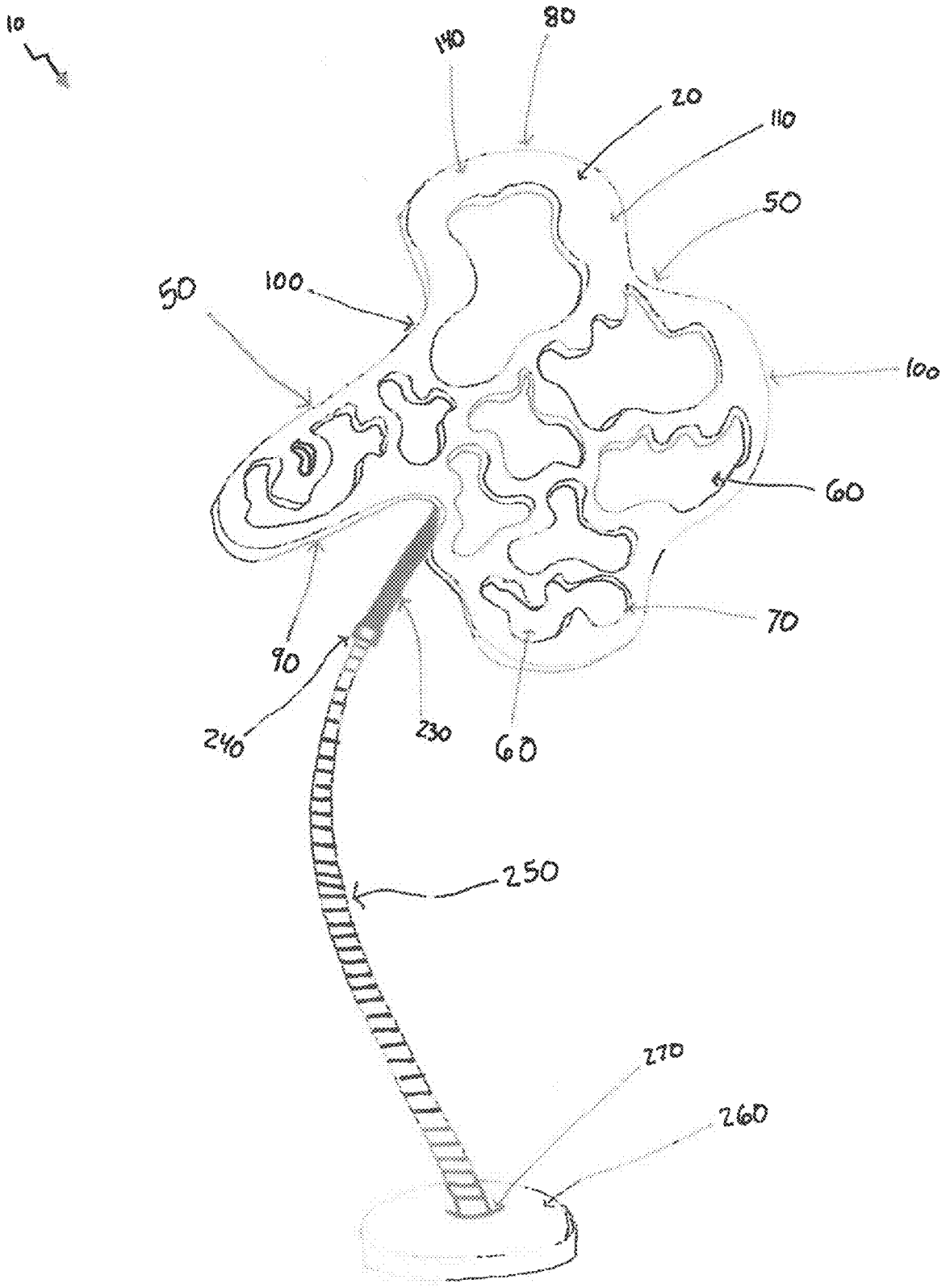
FIG. 1 is a perspective view of a preferred embodiment of the Light Modifying Device.

Referring now to the drawings in detail, FIG. 1 illustrates a preferred embodiment of a Light Modifying Device 10 constructed in accordance with the present invention, wherein a first face 20 is shown. The Light Modifying Device 10 itself is generally irregularly shaped, with non-linear edges 50 on the exterior edges thereof, known as the top edge 80, bottom edge 90, and side edges 100.

Upon said first face 20 is a first surface 110, which is where color, frost, or mirrored finish is applied. This creates a surface finish 140, which is the functional component as to the light waves being dispersed, reflected, refracted, minimized, allowed, or otherwise modified. Additionally shown are a plurality of defined openings 60, each of which is generally irregularly shaped 70. These defined openings 60 allow light waves to pass therethrough, and the surface finish 140 modifies the light waves that strike upon said first surface 110.

At a position near the bottom edge 90 of the Light Modifying Device 10 is a handle 230, which is known as a portion of the Light Modifying Device 10 able to be grasped by a human hand, or clamp, or opening, or device. This particular handle 230 is positioned within the gooseneck tubing 250 by way of an attachment point 240. The attachment point 240 may be a clamp, or a threaded attachment device. The gooseneck tubing 250 is attached to a solid base 260 by way of a gooseneck base attachment point 270.

Figure 2:
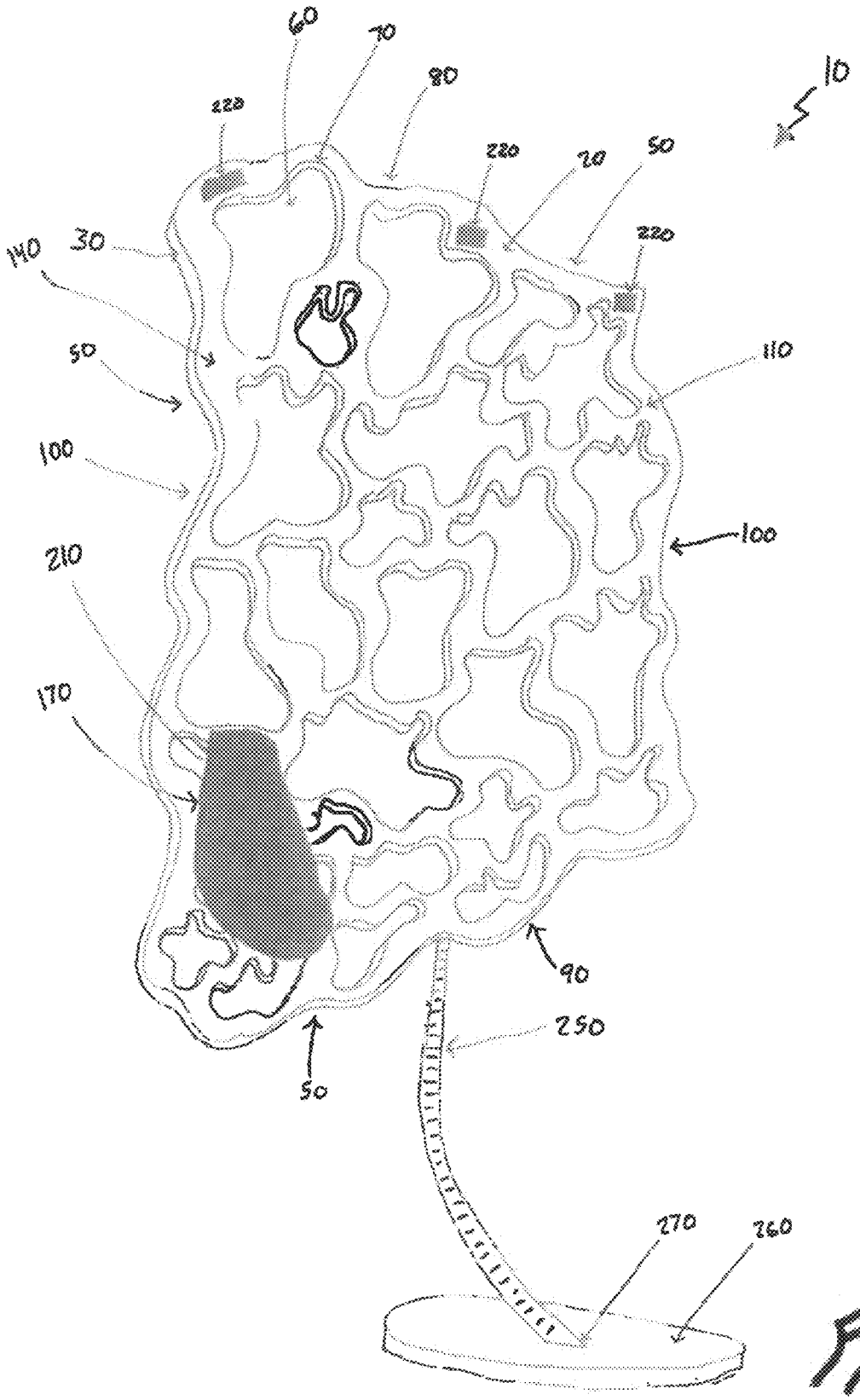
FIG. 2 is a perspective view of an alternative embodiment of the Light Modifying Device with attachment clips.

Looking at FIG. 2, a Light Modifying Device 10 is shown wherein attachment clips 220 are positioned on the first face 20. A coverage strip 170, a second Light Modifying Device 10, or other material may be positioned and removably attached thereto. The attachment clips 220 have the ability of quickly applying said material to cover part or all of a defined number of defined openings 60 in order to modify, enhance, or block light waves. This embodiment also employs a coverage strip 170 wherein adhesive is applied that removably affixes said coverage strip 170 to the first surface 110 in order to cover part of a defined opening or defined openings 60.

Figure 3:
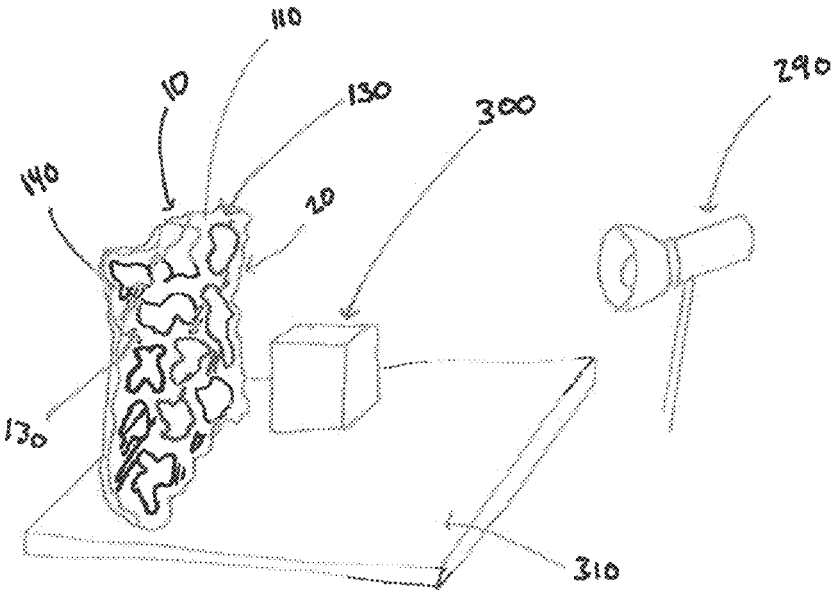
FIG. 3 is a perspective view of an embodiment of a Light Modifying Device with a mirrored image, wherein a subject material is placed between said Light Modifying Device and a generic photography light.

As described throughout, the second surface 120 need not have the same surface finish 140 as the first surface 110. Looking at FIG. 3 the surface finish 140 of the first surface 110 of the first face 20 is a mirrored surface 130. In such a fashion, the light emitted from the generic photography light 290 will strike the subject 300, and those around but not striking with reflect off the mirrored surface 130 of the Light Modifying Device 10 surface finish 140 and back light the subject 300.

Figure 4:
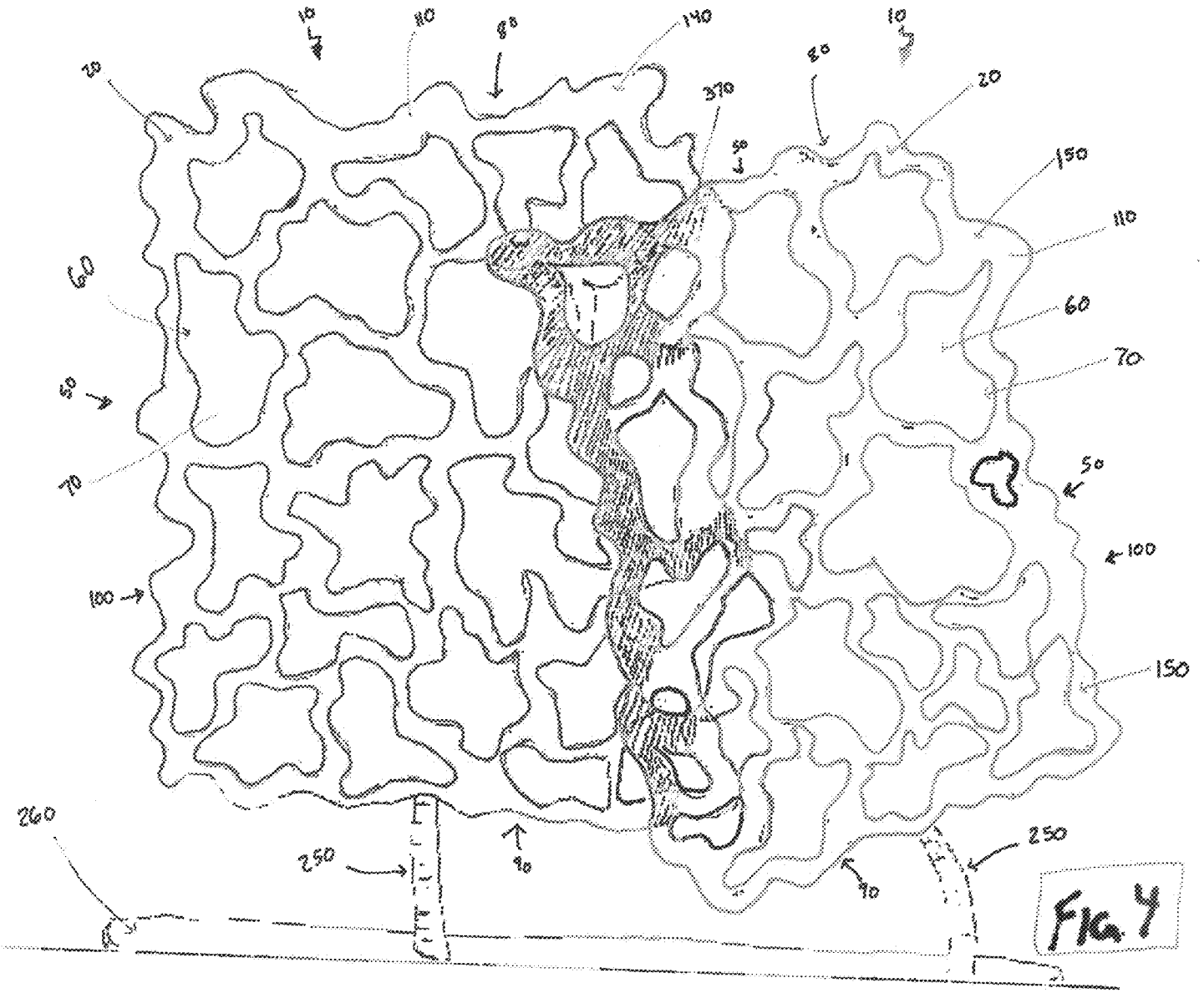
FIG. 4 is a front view of an embodiment of two Light Modifying Devices wherein a central base is utilized with gooseneck tubing, wherein one Light Modifying Device is bent and partially covers the second Light Modifying Device.

FIG. 4 shows a solid base 260 with two gooseneck tubings 250 attached thereon. Each of said gooseneck tubing 250 is connected to an individual Light Modifying Device 10. As is shown, the two Light Modifying Devices 10 are acting in concert with one another by way of bending the gooseneck tubing 250 itself. As is shown here, the light waves are modified by way of the frosted clear finish 150 of the Light Modifying Device 10, which creates the modified light 370 on the other Light Modifying Device 10, though the specific surface finish may be adjusted to change the particular light modification. Additionally, the solid base 260 comprises at least two gooseneck tubings 250 such that they are movable, and additionally able to be positioned without a human user being required to hold the Light Modifying Device 10 in a particular orientation. This is an advantageous feature, as holding a Light Modifying Device 10 may be cumbersome and fatiguing, such that before a photographic shot is taken, the Light Modifying Device 10 may be unintentionally repositioned as a result of arm fatigue. Thus, the solid base 260 allows for specific and exact positioning of, as is in the case of this figure, at least two Light Modifying Device 10 instruments.

Figure 5:
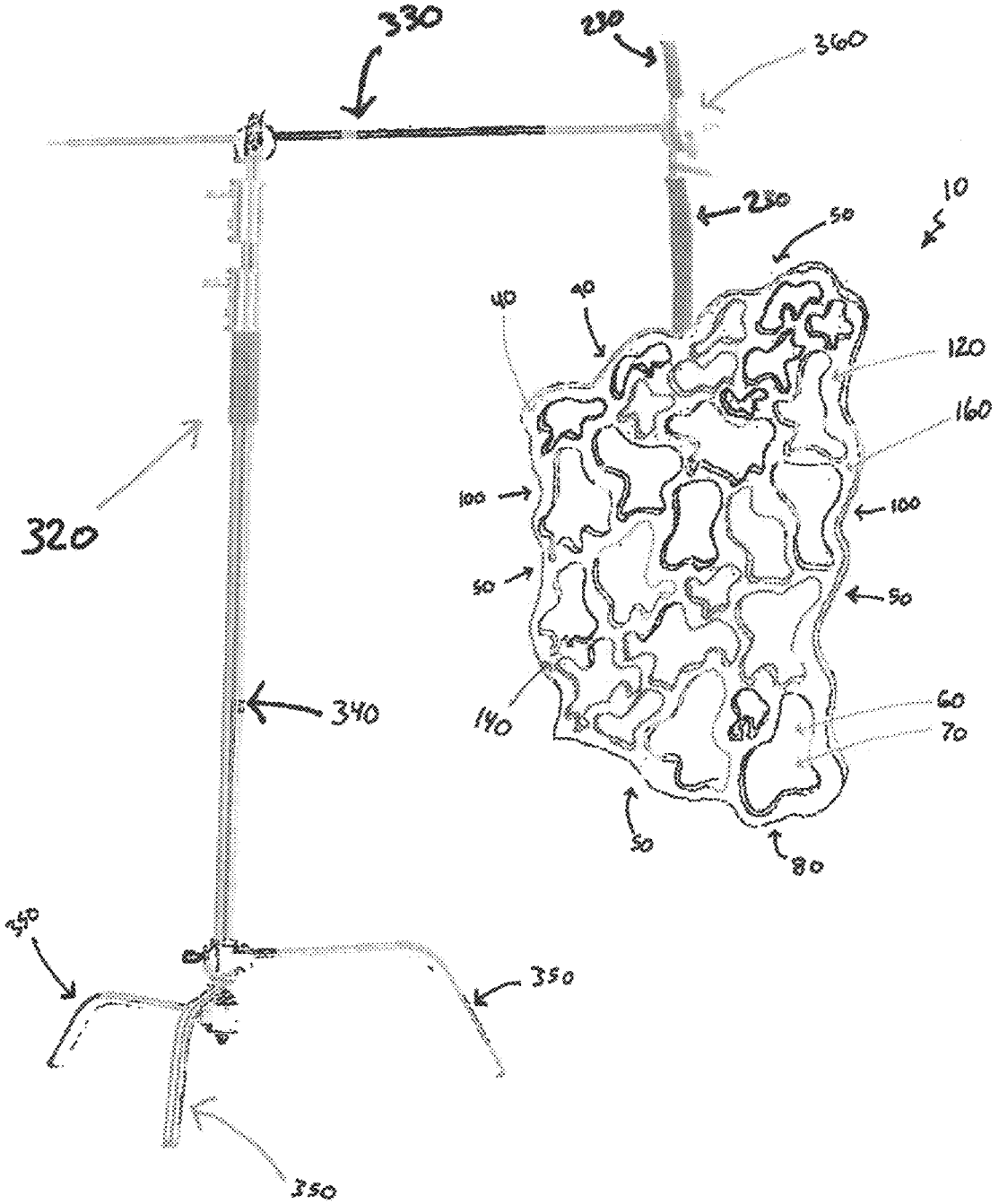
FIG. 5 is a generic photography stand with a raised arm and an attachment member holding an embodiment of the Light Modifying Device thereon.

Lastly, we look at FIG. 5, where an attachment device such as a C-Stand 320 is shown. The attachment device utilizes a central support member 340 having a support base member 350 on a first distal end of the central support member 340 and a raised arm 330 on a second distal end of the central support member 340. On or near a first distal end of the raised arm 330 is employed an attachment member 360. This allows for the removable attachment and subsequent detachment of a handle 230 on the Light Modifying Device 10. As shown here, the Light Modifying Device 10 is temporarily affixed in position on the C-Stand 320 by way of the handle 230 and the attachment device 360. Thus, a human user may rotate the raised arm 330, raise the height of the raised arm 330, or entirely reposition the central support member or support base member 350 into a second position to reposition the Light Modifying Device 10 as the user sees most appropriate based on the particular circumstances and their artistic preferences.

Understandably, the present invention has been described above in terms of one or more preferred embodiments and methods. It is recognized that various alternatives and modifications may be made to these embodiments and methods that are within the scope of the present invention. Various alternatives are contemplated as being within the scope of the present invention. It is also to be understood and appreciated that, although the foregoing description and drawings describe and illustrate in detail one or more preferred embodiments of the present invention, to those with skill in the art to which the present invention relates, the present disclosure will suggest many modifications and constructions, as well as widely differing embodiments and applications without thereby departing from the spirit and scope of the invention and method disclosed thereof.

What is claimed is:

1. An irregularly shaped light modifying device, comprising:

a panel having a first face a second face and defining a side width therebetween, said panel additionally having a top edge, a bottom edge, and a plurality of side edges;

a plurality of irregularly shaped openings positioned non-congruently on the panel first face, said irregularly shaped openings extending from the panel first face through the panel second face the entirety of the panel side width;

wherein said panel top edge is nonlinear;

wherein said panel bottom edge is nonlinear; and wherein the plurality of panel side edges are nonlinear.

2. The irregularly shaped light modifying device of claim 1, further comprising a handle having a first distal end and a second distal end, wherein the first distal end is located on the panel second face, and wherein the handle second distal end extends beyond the panel bottom edge.

3. The irregularly shaped light modifying device of claim 2, wherein the panel first face comprises a frosted clear finish.

4. The irregularly shaped light modifying device of claim 2, wherein the panel first face comprises an opaque light-resistant finish.

5. The irregularly shaped light modifying device of claim 2, wherein the panel first face comprises a color consisting of one of: red, green, and silver.

6. The irregularly shaped light modifying device of claim 2, wherein the panel first face comprises a mirrored finish.

7. The irregularly shaped light modifying device of claim 2, further comprising a photography C-Stand comprising a central support member, a raised arm, and an attachment member, wherein the handle second distal end is removably connected to the photography C-Stand attachment point.

8. The irregularly shaped light modifying device of claim 2, additionally comprising a gooseneck tubing having a first end and a second end, wherein the first end of the gooseneck tubing is attached to the second distal end of the handle.

9. The irregularly shaped light modifying device of claim 8, wherein the second end of the gooseneck tubing is attached to a solid base.

10. A light modifying device, comprising:

a transparent clear panel having a first face and a second face, and additionally comprising a top edge, a bottom edge, and a plurality of side edges;

a plurality of irregularly shaped openings positioned on the panel first face, said irregularly shaped openings extending from the panel first face through the panel second face;

a handle having a first end and a second end, wherein said handle first end is affixed to the bottom edge of the panel and wherein the handle second end extends beyond the transparent clear panel bottom edge;

wherein said panel top edge is nonlinear;

wherein said panel bottom edge is nonlinear; and wherein the plurality of panel side edges are nonlinear.

11. The light modifying device of claim 10, wherein the first face of the panel comprises a mirrored finish.

12. The light modifying device of claim 11, wherein the second face of the panel comprises an opaque finish.

13. The light modifying device of claim 11, wherein the second face of the panel comprises a color consisting of one of: red and green.

14. The light modifying device of claim 11, wherein the second face of the panel comprises a frosted clear finish.

15. The light modifying device of claim 10, wherein the panel first face additionally comprises a plurality of attachment clips.

16. The light modifying device of claim 15, additionally comprising a coverage strip removably affixed to one of said attachment clips.

17. A plurality of light modifying devices, comprising:

a first panel having a first panel first face a first panel second face and defining a side width therebetween, said first panel additionally having a top edge, a bottom edge, and a plurality of side edges;

a plurality of irregularly shaped openings positioned on the first panel first face, said irregularly shaped openings extending from the first panel first face through the first panel second face the entirety of the panel side width;

a handle having a first end and a second end, wherein said handle first end is affixed to the bottom edge of the first panel;

a first gooseneck tubing having a first end and a second end, wherein the first end of the first gooseneck tubing is attached to the second end of the first panel handle;

wherein said first panel top edge is nonlinear;

wherein said first panel bottom edge is nonlinear;

wherein the plurality of first panel side edges are nonlinear;

a second panel having a second panel first face a second panel second face and defining a side width therebetween, said second panel additionally having a top edge, a bottom edge, and a plurality of side edges;

a plurality of irregularly shaped openings positioned on the second panel first face, said irregularly shaped openings extending from the second panel first face through the second panel second face the entirety of the panel side width;

a handle having a first end and a second end, wherein said handle first end is affixed to the bottom edge of the second panel;

a second gooseneck tubing having a first end and a second end, wherein the first end of the second gooseneck tubing is attached to the second end of the second panel handle; and a solid base comprising a weighted element therein, said solid base attached to the second end of the first gooseneck tubing, and wherein said solid base is attached to the second end of the second gooseneck tubing.

18. The plurality of light modifying devices of claim 17, wherein said first panel first face comprises a frosted clear finish.

19. The plurality of light modifying devices of claim 18, wherein said second panel first face comprises an opaque finish.

20. The plurality of light modifying devices of claim 18, wherein said second panel first face comprises a color consisting of one of: red, green, and silver.

* * * * *